US008646527B2

(12) United States Patent
Trautman et al.

(10) Patent No.: US 8,646,527 B2
(45) Date of Patent: Feb. 11, 2014

(54) RADIO FREQUENCY ENHANCED STEAM ASSISTED GRAVITY DRAINAGE METHOD FOR RECOVERY OF HYDROCARBONS

(75) Inventors: Mark Trautman, Melbourne, FL (US); Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 480 days.

(21) Appl. No.: 12/886,304

(22) Filed: Sep. 20, 2010

(65) Prior Publication Data

US 2012/0067572 A1 Mar. 22, 2012

(51) Int. Cl.
*E21B 43/24* (2006.01)

(52) U.S. Cl.
USPC ..... 166/272.1; 166/272.3

(58) Field of Classification Search
USPC ..... 166/272.1, 272.3, 248, 249
See application file for complete search history.

(56) References Cited

U.S. PATENT DOCUMENTS

| | | | |
|---|---|---|---|
| 2,371,459 | A | 3/1945 | Mittelmann |
| 2,685,930 | A | 8/1954 | Albaugh |
| 3,497,005 | A | 2/1970 | Pelopsky |
| 3,848,671 | A | 11/1974 | Kern |
| 3,954,140 | A | 5/1976 | Hendrick |
| 3,988,036 | A | 10/1976 | Fisher |
| 3,991,091 | A | 11/1976 | Driscoll |
| 4,035,282 | A | 7/1977 | Stuchberry et al. |
| 4,042,487 | A | 8/1977 | Seguchi |
| 4,087,781 | A | 5/1978 | Grossi et al. |
| 4,136,014 | A | 1/1979 | Vermeulen |
| 4,140,179 | A | 2/1979 | Kasevich et al. |
| 4,140,180 | A | 2/1979 | Bridges et al. |
| 4,144,935 | A | 3/1979 | Bridges et al. |
| 4,146,125 | A | 3/1979 | Sanford et al. |

(Continued)

FOREIGN PATENT DOCUMENTS

| | | |
|---|---|---|
| CA | 1199573 A1 | 1/1986 |
| CA | 2678473 | 8/2009 |

(Continued)

OTHER PUBLICATIONS

U.S. Appl. No. 12/886,338, filed Sep. 20, 2010 (unpublished).

(Continued)

*Primary Examiner* — Daniel P Stephenson
(74) *Attorney, Agent, or Firm* — Allen, Dyer, Doppelt, Milbrath & Gilchrist, P.A.

(57) ABSTRACT

A method for heating a hydrocarbon formation is disclosed. A radio frequency applicator is positioned to provide radiation within the hydrocarbon formation. A first signal sufficient to heat the hydrocarbon formation through electric current is applied to the applicator. A second or alternate frequency signal is then applied to the applicator that is sufficient to pass through the desiccated zone and heat the hydrocarbon formation through electric or magnetic fields. A method for efficiently creating electricity and steam for heating a hydrocarbon formation is also disclosed. An electric generator, steam generator, and a regenerator containing water are provided. The electric generator is run. The heat created from running the electric generator is fed into the regenerator causing the water to be preheated. The preheated water is then fed into the steam generator. The RF energy from power lines or from an on site electric generator and steam that is harvested from the generator or provided separately are supplied to a reservoir as a process to recover hydrocarbons.

17 Claims, 8 Drawing Sheets

(56) References Cited

U.S. PATENT DOCUMENTS

| | | | | |
|---|---|---|---|---|
| 4,196,329 | A | 4/1980 | Rowland et al. | |
| 4,295,880 | A | 10/1981 | Horner | |
| 4,300,219 | A | 11/1981 | Joyal | |
| 4,301,865 | A | 11/1981 | Kasevich et al. | |
| 4,320,801 | A * | 3/1982 | Rowland et al. | 166/248 |
| 4,328,324 | A | 5/1982 | Kock | |
| 4,373,581 | A | 2/1983 | Toellner | |
| 4,396,062 | A | 8/1983 | Iskander | |
| 4,404,123 | A | 9/1983 | Chu | |
| 4,410,216 | A | 10/1983 | Allen | |
| 4,425,227 | A | 1/1984 | Smith | |
| 4,449,585 | A | 5/1984 | Bridges et al. | |
| 4,456,065 | A | 6/1984 | Heim | |
| 4,457,365 | A | 7/1984 | Kasevich et al. | |
| 4,470,459 | A | 9/1984 | Copland | |
| 4,485,869 | A | 12/1984 | Sresty | |
| 4,487,257 | A | 12/1984 | Dauphine | |
| 4,508,168 | A | 4/1985 | Heeren | |
| 4,514,305 | A | 4/1985 | Filby | |
| 4,524,826 | A | 6/1985 | Savage | |
| 4,524,827 | A | 6/1985 | Bridges | |
| 4,531,468 | A | 7/1985 | Simon | |
| 4,583,586 | A | 4/1986 | Fujimoto et al. | |
| 4,620,593 | A | 11/1986 | Haagensen | |
| 4,622,496 | A | 11/1986 | Dattili | |
| 4,645,585 | A | 2/1987 | White | |
| 4,678,034 | A | 7/1987 | Eastlund | |
| 4,703,433 | A | 10/1987 | Sharrit | |
| 4,790,375 | A | 12/1988 | Bridges | |
| 4,817,711 | A | 4/1989 | Jeambey | |
| 4,882,984 | A | 11/1989 | Eves, II | |
| 4,884,634 | A * | 12/1989 | Ellingsen | 166/248 |
| 4,892,782 | A | 1/1990 | Fisher et al. | |
| 5,046,559 | A | 9/1991 | Glandt | |
| 5,055,180 | A | 10/1991 | Klaila | |
| 5,065,819 | A | 11/1991 | Kasevich | |
| 5,082,054 | A | 1/1992 | Kiamanesh | |
| 5,136,249 | A | 8/1992 | White | |
| 5,199,488 | A | 4/1993 | Kasevich | |
| 5,233,306 | A | 8/1993 | Misra | |
| 5,236,039 | A | 8/1993 | Edelstein | |
| 5,251,700 | A | 10/1993 | Nelson | |
| 5,282,508 | A * | 2/1994 | Ellingsen et al. | 166/249 |
| 5,293,936 | A | 3/1994 | Bridges | |
| 5,304,767 | A | 4/1994 | MacGaffigan | |
| 5,315,561 | A | 5/1994 | Grossi | |
| 5,370,477 | A | 12/1994 | Bunin | |
| 5,378,879 | A | 1/1995 | Monovoukas | |
| 5,506,592 | A | 4/1996 | MacDonald | |
| 5,582,854 | A | 12/1996 | Nosaka | |
| 5,621,844 | A | 4/1997 | Bridges | |
| 5,631,562 | A | 5/1997 | Cram | |
| 5,746,909 | A | 5/1998 | Calta | |
| 5,910,287 | A | 6/1999 | Cassin | |
| 5,923,299 | A | 7/1999 | Brown et al. | |
| 6,045,648 | A | 4/2000 | Palmgren et al. | |
| 6,046,464 | A | 4/2000 | Schetzina | |
| 6,055,213 | A | 4/2000 | Rubbo | |
| 6,063,338 | A | 5/2000 | Pham | |
| 6,097,262 | A | 8/2000 | Combellack | |
| 6,106,895 | A | 8/2000 | Usuki | |
| 6,112,273 | A | 8/2000 | Kau | |
| 6,184,427 | B1 | 2/2001 | Klepfer | |
| 6,229,603 | B1 | 5/2001 | Coassin | |
| 6,232,114 | B1 | 5/2001 | Coassin | |
| 6,301,088 | B1 | 10/2001 | Nakada | |
| 6,303,021 | B2 | 10/2001 | Winter et al. | |
| 6,348,679 | B1 | 2/2002 | Ryan et al. | |
| 6,360,819 | B1 | 3/2002 | Vinegar | |
| 6,432,365 | B1 | 8/2002 | Levin | |
| 6,499,536 | B1 * | 12/2002 | Ellingsen | 166/248 |
| 6,603,309 | B2 | 8/2003 | Forgang | |
| 6,613,678 | B1 | 9/2003 | Sakaguchi | |
| 6,614,059 | B1 | 9/2003 | Tsujimura et al. | |
| 6,649,888 | B2 | 11/2003 | Ryan et al. | |
| 6,712,136 | B2 | 3/2004 | de Rouffignac | |
| 6,808,935 | B2 | 10/2004 | Levin | |
| 6,923,273 | B2 | 8/2005 | Terry | |
| 6,932,155 | B2 | 8/2005 | Vinegar | |
| 6,967,589 | B1 | 11/2005 | Peters | |
| 6,992,630 | B2 | 1/2006 | Parsche | |
| 7,046,584 | B2 | 5/2006 | Sorrells | |
| 7,079,081 | B2 | 7/2006 | Parsche et al. | |
| 7,091,460 | B2 | 8/2006 | Kinzer | |
| 7,109,457 | B2 | 9/2006 | Kinzer | |
| 7,115,847 | B2 | 10/2006 | Kinzer | |
| 7,147,057 | B2 | 12/2006 | Steele | |
| 7,172,038 | B2 | 2/2007 | Terry | |
| 7,205,947 | B2 | 4/2007 | Parsche | |
| 7,312,428 | B2 | 12/2007 | Kinzer | |
| 7,322,416 | B2 | 1/2008 | Burris, II | |
| 7,337,980 | B2 | 3/2008 | Schaedel | |
| 7,438,807 | B2 | 10/2008 | Garner et al. | |
| 7,441,597 | B2 | 10/2008 | Kasevich | |
| 7,461,693 | B2 | 12/2008 | Considine et al. | |
| 7,484,561 | B2 | 2/2009 | Bridges | |
| 7,562,708 | B2 | 7/2009 | Cogliandro | |
| 7,623,804 | B2 | 11/2009 | Sone | |
| 2002/0032534 | A1 | 3/2002 | Regier | |
| 2004/0031731 | A1 | 2/2004 | Honeycutt | |
| 2005/0199386 | A1 | 9/2005 | Kinzer | |
| 2005/0274513 | A1 | 12/2005 | Schultz | |
| 2006/0038083 | A1 | 2/2006 | Criswell | |
| 2007/0108202 | A1 | 5/2007 | Kinzer | |
| 2007/0131591 | A1 | 6/2007 | Pringle | |
| 2007/0137852 | A1 | 6/2007 | Considine et al. | |
| 2007/0137858 | A1 | 6/2007 | Considine et al. | |
| 2007/0187089 | A1 | 8/2007 | Bridges | |
| 2007/0215613 | A1 * | 9/2007 | Kinzer | 219/764 |
| 2007/0261844 | A1 | 11/2007 | Cogliandro et al. | |
| 2008/0073079 | A1 | 3/2008 | Tranquilla | |
| 2008/0143330 | A1 | 6/2008 | Madio | |
| 2009/0009410 | A1 | 1/2009 | Dolgin et al. | |
| 2009/0050318 | A1 | 2/2009 | Kasevich | |
| 2009/0242196 | A1 | 10/2009 | Pao | |
| 2012/0067580 | A1 * | 3/2012 | Parsche | 166/302 |
| 2012/0118565 | A1 * | 5/2012 | Trautman et al. | 166/272.6 |
| 2012/0318498 | A1 * | 12/2012 | Parsche | 166/248 |

FOREIGN PATENT DOCUMENTS

| | | | |
|---|---|---|---|
| EP | 0 135 966 | | 4/1985 |
| EP | 0563999 | A2 | 10/1993 |
| EP | 1106672 | A1 | 6/2001 |
| WO | WO 2007/133461 | | 11/2007 |
| WO | WO2008/011412 | A2 | 1/2008 |
| WO | WO 2008/030337 | | 3/2008 |
| WO | WO2008098850 | A1 | 8/2008 |
| WO | WO2009027262 | A1 | 3/2009 |
| WO | W02009/114934 | A1 | 9/2009 |

OTHER PUBLICATIONS

Butler, R.M. "Theoretical Studies on the Gravity Drainage of Heavy Oil During In-Situ Steam Heating", Can J. Chem Eng, vol. 59, 1981.

Butler, R. and Mokrys, I., "A New Process (VAPEX) for Recovering Heavy Oils Using Hot Water and Hydrocarbon Vapour", Journal of Canadian Petroleum Technology, 30(1), 97-106, 1991.

Butler, R. and Mokrys, I., "Recovery of Heavy Oils Using Vapourized Hydrocarbon Solvents: Further Development of the VAPEX Process", Journal of Canadian Petroleum Technology, 32(6), 56-62, 1993.

Butler, R. and Mokrys, I., "Closed Loop Extraction Method for the Recovery of Heavy Oils and Bitumens Underlain by Aquifers: the VAPEX Process", Journal of Canadian Petroleum Technology, 37(4), 41-50, 1998.

Das, S.K. and Butler, R.M., "Extraction of Heavy Oil and Bitumen Using Solvents at Reservoir Pressure" CIM 95-118, presented at the CIM 1995 Annual Technical Conference in Calgary, Jun. 1995.

Das, S.K. and Butler, R.M., "Diffusion Coefficients of Propane and Butane in Peace River Bitumen" Canadian Journal of Chemical Engineering, 74, 988-989, Dec. 1996.

(56) References Cited

OTHER PUBLICATIONS

Das, S.K. and Butler, R.M., "Mechanism of the Vapour Extraction Process for Heavy Oil and Bitumen", Journal of Petroleum Science and Engineering, 21, 43-59, 1998.
Dunn, S.G., Nenniger, E. and Rajan, R., "A Study of Bitumen Recovery by Gravity Drainage Using Low Temperature Soluble Gas Injection", Canadian Journal of Chemical Engineering, 67, 978-991, Dec. 1989.
Frauenfeld, T., Lillico, D., Jossy, C., Vilcsak, G., Rabeeh, S. and Singh, S., "Evaluation of Partially Miscible Processes for Alberta Heavy Oil Reservoirs", Journal of Canadian Petroleum Technology, 37(4), 17-24, 1998.
Mokrys, I., and Butler, R., "In Situ Upgrading of Heavy Oils and Bitumen by Propane Deasphalting: The VAPEX Process", SPE 25452, presented at the SPE Production Operations Symposium held in Oklahoma City OK USA, Mar. 21-23 1993.
Nenniger, J.E. and Dunn, S.G., "How Fast is Solvent Based Gravity Drainage?", CIPC 2008-139, presented at the Canadian International Petroleum Conference, held in Calgary, Alberta Canada, Jun. 17-19, 2008.
Nenniger, J.E. and Gunnewick, L., "Dew Point vs. Bubble Point: A Misunderstood Constraint on Gravity Drainage Processes", CIPC 2009-065, presented at the Canadian International Petroleum Conference, held in Calgary, Alberta Canada, Jun. 16-18, 2009.
Bridges, J.E., Sresty, G.C., Spencer, H.L. and Wattenbarger, R.A., "Electromagnetic Stimulation of Heavy Oil Wells", 1221-1232, Third International Conference on Heavy Oil Crude and Tar Sands, UNITAR/UNDP, Long Beach California, USA Jul. 22-31, 1985.
Carrizales, M.A., Lake, L.W. and Johns, R.T., "Production Improvement of Heavy Oil Recovery by Using Electromagnetic Heating", SPE115723, presented at the 2008 SPE Annual Technical Conference and Exhibition held in Denver, Colorado, USA, Sep. 21-24, 2008.
Carrizales, M. and Lake, L.W., "Two-Dimensional COMSOL Simulation of Heavy-Oil Recovery by Electromagnetic Heating", Proceedings of the COMSOL Conference Boston, 2009.
Chakma, A. and Jha, K.N., "Heavy-Oil Recovery from Thin Pay Zones by Electromagnetic Heating", SPE24817, presented at the 67th Annual Technical Conference and Exhibition of the Society of Petroleum Engineers held in Washington, DC, Oct. 4-7, 1992.
Chhetri, A.B. and Islam, M.R., "A Critical Review of Electromagnetic Heating for Enhanced Oil Recovery", Petroleum Science and Technology, 26(14), 1619-1631, 2008.
Chute, F.S., Vermeulen, F.E., Cervenan, M.R. and McVea, F.J., "Electrical Properties of Athabasca Oil Sands", Canadian Journal of Earth Science, 16, 2009-2021, 1979.
Davidson, R.J., "Electromagnetic Stimulation of Lloydminster Heavy Oil Reservoirs", Journal of Canadian Petroleum Technology, 34(4), 15-24, 1995.
Hu, Y., Jha, K.N. and Chakma, A., "Heavy-Oil Recovery from Thin Pay Zones by Electromagnetic Heating", Energy Sources, 21(1-2), 63-73, 1999.
Kasevich, R.S., Price, S.L., Faust, D.L. and Fontaine, M.F., "Pilot Testing of a Radio Frequency Heating System for Enhanced Oil Recovery from Diatomaceous Earth", SPE28619, presented at the SPE 69th Annual Technical Conference and Exhibition held in New Orleans LA, USA, Sep. 25-28, 1994.
Koolman, M., Huber, N., Diehl, D. and Wacker, B., "Electromagnetic Heating Method to Improve Steam Assisted Gravity Drainage", SPE117481, presented at the 2008 SPE International Thermal Operations and Heavy Oil Symposium held in Calgary, Alberta, Canada, Oct. 20-23, 2008.
Kovaleva, L.A., Nasyrov, N.M. and Khaidar, A.M., Mathematical Modelling of High-Frequency Electromagnetic Heating of the Bottom-Hole Area of Horizontal Oil Wells, Journal of Engineering Physics and Thermophysics, 77(6), 1184-1191, 2004.
McGee, B.C.W. and Donaldson, R.D., "Heat Transfer Fundamentals for Electro-thermal Heating of Oil Reservoirs", CIPC 2009-024, presented at the Canadian International Petroleum Conference, held in Calgary, Alberta, Canada Jun. 16-18, 2009.
Ovalles, C., Fonseca, A., Lara, A., Alvarado, V., Urrecheaga, K, Ranson, A. and Mendoza, H., "Opportunities of Downhole Dielectric Heating in Venezuela: Three Case Studies Involving Medium, Heavy and Extra-Heavy Crude Oil Reservoirs" SPE78980, presented at the 2002 SPE International Thermal Operations and Heavy Oil Symposium and International Horizontal Well Technology Conference held in Calgary, Alberta, Canada, Nov. 4-7, 2002.
Rice, S.A., Kok, A.L. and Neate, C.J., "A Test of the Electric Heating Process as a Means of Stimulating the Productivity of an Oil Well in the Schoonebeek Field", CIM 92-04 presented at the CIM 1992 Annual Technical Conference in Calgary, Jun. 7-10, 1992.
Sahni, A. and Kumar, M. "Electromagnetic Heating Methods for Heavy Oil Reservoirs", SPE62550, presented at the 2000 SPE/AAPG Western Regional Meeting held in Long Beach, California, Jun. 19-23, 2000.
Sayakhov, F.L., Kovaleva, L.A. and Nasyrov, N.M., "Special Features of Heat and Mass Exchange in the Face Zone of Boreholes upon Injection of a Solvent with a Simultaneous Electromagnetic Effect", Journal of Engineering Physics and Thermophysics, 71(1), 161-165, 1998.
Spencer, H.L., Bennett, K.A. and Bridges, J.E. "Application of the IITRI/Uentech Electromagnetic Stimulation Process to Canadian Heavy Oil Reservoirs" Paper 42, Fourth International Conference on Heavy Oil Crude and Tar Sands, UNITAR/UNDP, Edmonton, Alberta, Canada, Aug. 7-12, 1988.
Sresty, G.C., Dev, H., Snow, R.N. and Bridges, J.E., "Recovery of Bitumen from Tar Sand Deposits with the Radio Frequency Process", SPE Reservoir Engineering, 85-94, Jan. 1986.
Vermulen, F. and McGee, B.C.W., "In Situ Electromagnetic Heating for Hydrocarbon Recovery and Environmental Remediation", Journal of Canadian Petroleum Technology, Distinguished Author Series, 39(8), 25-29, 2000.
Schelkunoff, S.K. and Friis, H.T., "Antennas: Theory and Practice", John Wiley & Sons, Inc., London, Chapman Hall, Limited, pp. 229-244, 351-353, 1952.
Gupta, S.C., Gittins, S.D., "Effect of Solvent Sequencing and Other Enhancement on Solvent Aided Process", Journal of Canadian Petroleum Technology, vol. 46, No. 9, pp. 57-61, Sep. 2007.
PCT Notification of Transmittal of the International Search Report and the Written Opinion of the International Searching Authority, or the Declaration, in PCT/US2010/025761, dated Feb. 9, 2011.
PCT Notification of Transmittal of the International Search Report and the Written Opinion of the International Searching Authority, or the Declaration, in PCT/US2010/057090, dated Mar. 3, 2011.
"Control of Hazardous Air Pollutants From Mobile Sources", U.S. Environmental Protection Agency, Mar. 29, 2006. p. 15853 (http://www.epa.gov/EPA-AIR/2006/March/Day-29/a2315b.htm).
Von Hippel, Arthur R., Dielectrics and Waves, Copyright 1954, Library of Congress Catalog Card No. 54-11020, Contents, pp. xi-xii; Chapter II, Section 17, "Polyatomic Molecules", pp. 150-155; Appendix C-E, pp. 273-277, New York, John Wiley and Sons.
United States Patent and Trademark Office, Non-final Office action issued in U.S. Appl. No. 12/396,247, dated Mar. 28, 2011.
United States Patent and Trademark Office, Non-final Office action issued in U.S. Appl. No. 12/396,284, dated Apr. 26, 2011.
Patent Cooperation Treaty, Notification of Transmittal of the International Search Report and the Written Opinion of the International Searching Authority, or the Declaration, in PCT/US2010/025808, dated Apr. 5, 2011.
Deutsch, C.V., McLennan, J.A., "The Steam Assisted Gravity Drainage (SAGD) Process," Guide to SAGD (Steam Assisted Gravity Drainage) Reservoir Characterization Using Geostatistics, Centre for Computational Statistics (CCG), Guidebook Series, 2005, vol. 3; p. 2, section 1.2, published by Centre for Computational Statistics, Edmonton, AB, Canada.
Marcuvitz, Nathan, Waveguide Handbook; 1986; Institution of Engineering and Technology, vol. 21 of IEE Electromagnetic Wave series, ISBN 0863410588, Chapter 1, pp. 1-54, published by Peter Peregrinus Ltd. on behalf of the Institution of Electrical Engineers, © 1986.
Marcuvitz, Nathan, Waveguide Handbook; 1986; Institution of Engineering and Technology, vol. 21 of IEE Electromagnetic Wave series,

(56) References Cited

OTHER PUBLICATIONS

ISBN 0863410588, Chapter 2.3, pp. 66-72, published by Peter Peregrinus Ltd. on behalf of The Institution of Electrical Engineers, © 1986.
"Oil sands." Wikipedia, the free encyclopedia. Retrieved from the Internet from: http://en.wikipedia.org/w/index.php? title=Oil_sands &printable=yes, Feb. 16, 2009.
Sahni et al., "Electromagnetic Heating Methods for Heavy Oil Reservoirs." 2000 Society of Petroleum Engineers SPE/AAPG Western Regional Meeting, Jun. 19-23, 2000.
Power et al., "Froth Treatment: Past, Present & Future." Oil Sands Symposium, University of Alberta, May 3-5, 2004.
Flint, "Bitumen Recovery Technology a Review of Long Term R&D Opportunities." Jan. 31, 2005. LENEF Consulting (1994) Limited.
"Froth Flotation." Wikipedia, the free encyclopedia. Retrieved from the internet from: http://en.wikipedia.org/wiki/Froth_flotation, Apr. 7, 2009.
"Relative static permittivity." Wikipedia, the free encyclopedia. Retrieved from the Internet from http://en.wikipedia.org/w/index/php?title=Relative_static_permittivity&printable=yes, Feb. 12, 2009.
"Tailings." Wikipedia, the free encyclopedia. Retrieved from the Internet from http://en.wikipedia.org/w/index.php? title=Tailings &printable=yes, Feb. 12, 2009.
"Technologies for Enhanced Energy Recovery" Executive Summary, Radio Frequency Dielectric Heating Technologies for Conventional and Non-Conventional Hydrocarbon-Bearing Formulations, Quasar Energy, LLC, Sep. 3, 2009, pp. 1-6.
Burnhan, "Slow Radio-Frequency Processing of Large Oil Shale Volumes to Produce Petroleum-like Shale Oil," U. S. Department of Energy, Lawrence Livermore National Laboratory, Aug. 20, 2003, UCRL-ID-155045.
Sahni et al., "Electromagnetic Heating Methods for Heavy Oil Reservoirs," U.S. Department of Energy, Lawrence Livermore National Laboratory, May 1, 2000, UCL-JC-138802.
Abernethy, "Production Increase of Heavy Oils by Electromagnetic Heating," The Journal of Canadian Petroleum Technology, Jul.-Sep. 1976, pp. 91-97.
Sweeney, et al., "Study of Dielectric Properties of Dry and Saturated Green River Oil Shale," Lawrence Livermore National Laboratory, Mar. 26, 2007, revised manuscript Jun. 29, 2007, published on Web Aug. 25, 2007.
Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-18.
Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-33.
Kinzer, A Review of Notable Intellectual Property for in Situ Electromagnetic Heating of Oil Shale, Quasar Energy LLC.
A. Godio: "Open ended-coaxial Cable Measurements of Saturated Sandy Soils", American Journal of Environmental Sciences, vol. 3, No. 3, 2007, pp. 175-182, XP002583544.
Carlson et al., "Development of the I IT Research Institute RF Heating Process for in Situ Oil Shale/Tar Sand Fuel Extraction—An Overview", Apr. 1981.
PCT International Search Report and Written Opinion in PCT/US2010/025763, Jun. 4, 2010.
PCT International Search Report and Written Opinion in PCT/US2010/025807, Jun. 17, 2010.
PCT International Search Report and Written Opinion in PCT/US2010/025804, Jun. 30, 2010.
PCT International Search Report and Written Opinion in PCT/US2010/025769, Jun. 10, 2010.
PCT International Search Report and Written Opinion in PCT/US2010/025765, Jun. 30, 2010.
PCT International Search Report and Written Opinion in PCT/US2010/025772, Aug. 9, 2010.

* cited by examiner

RADIO FREQUENCY ENHANCED STEAM ASSISTED GRAVITY DRAINAGE METHOD FOR RECOVERY OF HYDROCARBONS

CROSS REFERENCE TO RELATED APPLICATIONS

This specification is related to U.S. patent application Ser. No. 12/686,338, filed Sep. 20, 2010, now U.S. Patent Application Publication No. 2012/0067580, published Mar. 22, 2012, which is incorporated by reference here.

BACKGROUND OF THE INVENTION

The present invention relates to heating a geological formation for the extraction of hydrocarbons, which is a technique of well stimulation. In particular, the present invention relates to an advantageous method that can be used to heat a geological formation to extract heavy hydrocarbons.

As the world's standard crude oil reserves are depleted, and the continued demand for oil causes oil prices to rise, oil producers are attempting to process hydrocarbons from bituminous ore, oil sands, tar sands, and heavy oil deposits. These materials are often found in naturally occurring mixtures of sand or clay. Because of the extremely high viscosity of bituminous deposits, oil sands, oil shale, tar sands, and heavy oil, the drilling and refinement methods used in extracting standard crude oil are typically not available. Therefore, recovery of oil from these deposits requires heating to extract hydrocarbons from other geologic materials and to maintain hydrocarbons at temperatures at which they will flow.

Current technology heats the hydrocarbon formations through the use of steam and sometimes through the use of electric or radio frequency (RF) heating. Steam has been used to provide heat in-situ, such as through a steam assisted gravity drainage (SAGD) system. Electric heating methods generally use electrodes in the formation and the electrodes may require continuous contact with liquid water.

A list of possibly relevant patents and literature follows:

| | |
|---|---|
| US 2007/0261844 | Cogliandro et al. |
| US 2008/0073079 | Tranquilla et al. |
| 2,685,930 | Albaugh |
| 3,954,140 | Hendrick |
| 4,140,180 | Bridges et al. |
| 4,144,935 | Bridges et al. |
| 4,328,324 | Kock et al. |
| 4,373,581 | Toellner |
| 4,410,216 | Allen |
| 4,457,365 | Kasevich et al. |
| 4,485,869 | Sresty et al. |
| 4,508,168 | Heeren |
| 4,524,827 | Bridges et al. |
| 4,620,593 | Haagensen |
| 4,622,496 | Dattilo et al. |
| 4,678,034 | Eastlund et al. |
| 4,790,375 | Bridges et al. |
| 5,046,559 | Glandt |
| 5,082,054 | Kiamanesh |
| 5,236,039 | Edelstein et al. |
| 5,251,700 | Nelson et al. |
| 5,293,936 | Bridges |
| 5,370,477 | Bunin et al. |
| 5,621,844 | Bridges |
| 5,910,287 | Cassin et al. |
| 6,046,464 | Schetzina |
| 6,055,213 | Rubbo et al. |
| 6,063,338 | Pham et al. |
| 6,112,273 | Kau et al. |
| 6,229,603 | Coassin, et al. |

-continued

| | |
|---|---|
| 6,232,114 | Coassin, et al. |
| 6,301,088 | Nakada |
| 6,360,819 | Vinegar |
| 6,432,365 | Levin et al. |
| 6,603,309 | Forgang, et al. |
| 6,613,678 | Sakaguchi et al. |
| 6,614,059 | Tsujimura et al. |
| 6,712,136 | de Rouffignac et al. |
| 6,808,935 | Levin et al. |
| 6,923,273 | Terry et al. |
| 6,932,155 | Vinegar et al. |
| 6,967,589 | Peters |
| 7,046,584 | Sorrells et al. |
| 7,109,457 | Kinzer |
| 7,147,057 | Steele et al. |
| 7,172,038 | Terry et al |
| 7,322,416 | Burris, II et al. |
| 7,337,980 | Schaedel et al. |
| US2007/0187089 | Bridges |
| Development of the IIT Research Institute RF Heating Process for In Situ Oil Shale/Tar Sand Fuel Extraction - An Overview | Carlson et al. |

SUMMARY OF THE INVENTION

An embodiment of the present invention is a method for heating a hydrocarbon formation. A radio frequency applicator is positioned to produce electromagnetic energy within a hydrocarbon formation in a location where water is present near the applicator. A signal, sufficient to heat the hydrocarbon formation through electric current, is applied to the applicator. The same or an alternate frequency signal is then applied to the applicator that is sufficient to heat the hydrocarbon formation through electric fields, magnetic fields, or both.

Another aspect of the present invention is a method for efficiently creating electricity and steam to heat a hydrocarbon formation. An electric generator, steam generator, and a regenerator containing water are provided. The electric generator is run. The excess heat created from running the electric generator is recycled by feeding it into the regenerator causing the water to be preheated or even steamed. The preheated water or steam is then fed into the steam generator, which improves the overall efficiency of the process.

Other aspects of the invention will be apparent from this disclosure.

DETAILED DESCRIPTION OF THE PREFERRED EMBODIMENTS

Figure 1:
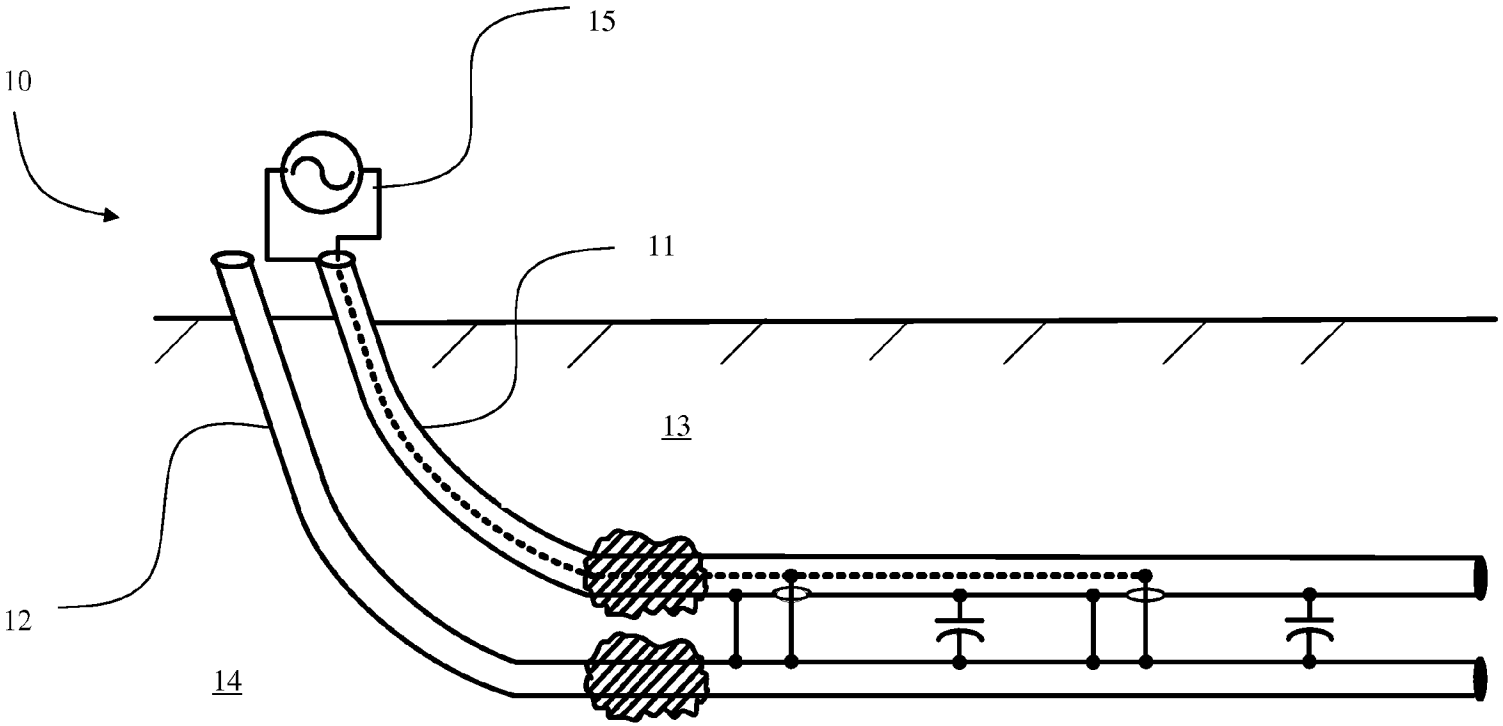
FIG. 1 is a diagrammatic cutaway view of a steam assisted gravity drainage (SAGD) system adapted to also operate as a radio frequency applicator.

The subject matter of this disclosure will now be described more fully, and one or more embodiments of the invention are shown. This invention may, however, be embodied in many different forms and should not be construed as limited to the embodiments set forth herein. Rather, these embodiments are examples of the invention, which has the full scope indicated by the language of the claims.

The viscosity of oil decreases dramatically as its temperature is increased. Butler [1972] showed that the oil recovery rate is proportional to the square root of the viscosity of the oil in the reservoir. Thus the oil production rate is strongly influenced by the temperature of the hydrocarbon, with higher temperatures yielding significantly higher production rates. The application of electromagnetic heating to the hydrocarbons increases the hydrocarbon temperature and thus increases the hydrocarbon production rate.

Electromagnetic heating uses one or more of three energy forms: electric currents, electric fields, and magnetic fields at radio frequencies. Depending on operating parameters, the heating mechanism may be resistive by Joule effect or dielectric by molecular moment. Resistive heating by Joule effect is often described as electric heating, where electric current flows through a resistive material. The electrical work provides the heat which may be reconciled according to the well known relationships of $P=I^2 R$ and $Q=I^2 R t$. Dielectric heating occurs where polar molecules, such as water, change orientation when immersed in an electric field and dielectric heating occurs according to $P=\omega\in_r''\in_0 E^2$ and $Q=\omega\in_r''\in_0 E^2 t$. Magnetic fields also heat electrically conductive materials through the formation of eddy currents, which in turn heat resistively. Thus magnetic fields can provide resistive heating without conductive electrode contact.

Electromagnetic heating can use electrically conductive antennas to function as heating applicators. The antenna is a passive device that converts applied electrical current into electric fields, magnetic fields, and electrical currents in the target material, without having to heat the structure to a specific threshold level. Preferred antenna shapes can be Euclidian geometries, such as lines and circles. Additional background information on dipole antennas can be found at S. K. Schelkunoff and H. T. Friis, *Antennas: Theory and Practice, pp* 229-244, 351-353 (Wiley New York 1952). The radiation pattern of an antenna can be calculated by taking the Fourier transform of the antenna's electric current flow. Modern techniques for antenna field characterization may employ digital computers and provide for precise RF heat mapping.

Antennas, including antennas for electromagnetic heat application, can provide multiple field zones which are determined by the radius from the antenna r and the electrical wavelength $\lambda$ (lambda). Although there are several names for the zones they can be referred to as a near field zone, a middle field zone, and a far field zone. The near field zone can be within a radius $r<\lambda/2\pi$ (r less than lambda over 2 pi) from the antenna, and it contains both magnetic and electric fields. The near field zone energies are useful for heating hydrocarbon deposits, and the antenna does not need to be in electrically conductive contact with the formation to form the near field heating energies. The middle field zone is of theoretical importance only. The far field zone occurs beyond $r>\lambda/\pi$ (r greater than lambda over pi), is useful for heating hydrocarbon formations, and is especially useful for heating formations when the antenna is contained in a reservoir cavity. In the far field zone, radiation of radio waves occurs and the reservoir cavity walls may be at any distance from the antenna if sufficient energy is applied relative the heating area. Thus, reliable heating of underground formations is possible with radio frequency electromagnetic energy with antennas insulated from and spaced from the formation. The electrical wavelength may be calculated as $\lambda=c/f$ which is the speed of light divided by the frequency. In media this value is multiplied by $\sqrt{\mu/\in}$ which is the square root of the media magnetic permeability divided by media electric permittivity.

Susceptors are materials that heat in the presence of RF energies. Salt water is a particularly good susceptor for electromagnetic heating; it can respond to all three RF energies: electric currents, electric fields, and magnetic fields. Oil sands and heavy oil formations commonly contain connate liquid water and salt in sufficient quantities to serve as an electromagnetic heating susceptor. For instance, in the Athabasca region of Canada and at 1 KHz frequency, rich oil sand (15% bitumen) may have about 0.5-5% water by weight, an electrical conductivity of about 0.01 s/m, and a relative dielectric permittivity of about 120. As bitumen becomes mobile at or below the boiling point of water at reservoir conditions, liquid water may be a used as an electromagnetic heating susceptor during bitumen extraction, permitting well stimulation by the application of RF energy. In general, electromagnetic heating has superior penetration and heating rate compared to conductive heating in hydrocarbon formations. Electromagnetic heating may also have properties of thermal regulation because steam is not an electromagnetic heating susceptor. In other words, once the water is heated sufficiently to vaporize, it is no longer electrically conductive and is not further heated to any substantial degree by continued application of electrical energy.

In certain embodiments, the applicator may be formed from one or more pipes of a steam assisted gravity drainage (SAGD) system. An SAGD system is an existing type of system for extracting heavy hydrocarbons. In other embodiments, the applicator may be located adjacent to an SAGD system. In yet other embodiments, the applicator may be located near an extraction pipe that is not part of a traditional SAGD system. In these embodiments, using electromagnetic heating in a stand alone configuration or in conjunction with steam injection accelerates heat penetration within the reservoir thereby promoting faster heavy oil recovery. Supplementing the heat provided by steam with electromagnetic energy also dramatically reduces the water consumption of the extraction process. Electromagnetic heating that reduces or even eliminates water consumption is very advantageous because in some hydrocarbon formations water can be scarce. Additionally, processing water prior to steam injection and downstream in the oil separation and upgrading processes can be very expensive. Therefore, incorporating electromagnetic heating in accordance with this invention provides significant advantages over existing methods.

FIG. 1 depicts a radio frequency applicator 10 formed from the existing pipes of an SAGD system. It includes at least two well pipes 11 and 12 that extend downward through an overburden region 13 into a hydrocarbon formation 14. The portions of the steam injection pipe 11 and the extraction pipe 12 within the hydrocarbon formation 14 are positioned so that steam or liquid released from the steam injection pipe 11 heats the hydrocarbon formation 14, which causes the heavy oil or bitumen to become mobile and flow within the hydrocarbon formation 14 to the extraction pipe 12. The pipes are electrically connected, and powered through a radio frequency transmitter and coupler 15. The applicator 10 is disclosed in greater detail in copending application U.S. patent application Ser. No. 12/886,338, filed Sep. 20, 2010, now U.S. Patent Application Publication No. 2012/0067580, published Mar. 22, 2012, which is incorporated by reference here. The applicator 10 is an example of an applicator that can be utilized to heat the formation in accordance with the methods described below. However, variations and alternatives to such an applicator can be employed. And the methods below are not limited to any particular applicator configuration.

Figure 2:
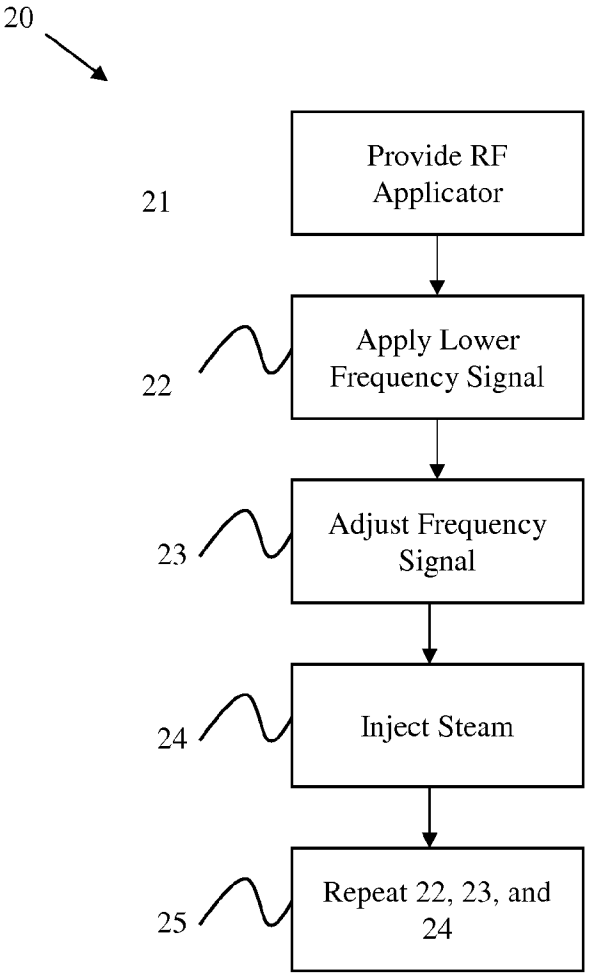
FIG. 2 is a flow diagram illustrating a method of applying heat to a hydrocarbon formation.

FIG. 2 is a flow diagram illustrating a method of applying heat to a hydrocarbon formation 20. At the step 21, a radio frequency applicator is provided and is positioned to provide electromagnetic energy within the hydrocarbon formation in an area where water is present. At the step 22, a signal sufficient to heat the formation through conducted electric currents is applied to the applicator until the water near the applicator is nearly or completely desiccated (i.e. removed). At the step 23, the same signal or an alternate signal than applied in the step 22 is applied to the applicator, which is sufficient to pass through the desiccated zone and heat the hydrocarbon formation through an electric field, a magnetic field, or both.

At the step 21, a radio frequency applicator is provided and is positioned to provide electromagnetic energy within the hydrocarbon formation in an area where water is present within the hydrocarbon formation. The applicator can be located within the hydrocarbon formation or adjacent to the hydrocarbon formation, so long as the radiation produced from the applicator penetrates the hydrocarbon formation. The applicator can be any structure that radiates when a radio frequency signal is applied. For example, it can resemble the applicator described above with respect to FIG. 1.

At the step 22, a signal is applied to the applicator, which is sufficient to heat the formation through electric current until the water near the applicator is nearly or completely desiccated. At relatively low frequencies (less than 500 Hz) or at DC, the applicator can provide resistive heating within the hydrocarbon formation by Joule effect. The Joule effect resistive heating occurs through current flow due to direct contact with the conductive applicator. The particular frequency applied can vary depending on the conductivity of the media within a particular hydrocarbon formation, however, signals with frequencies between about 0 to 500 Hz and including DC are contemplated to heat a typical formation through electric currents. As the water near the applicator is desiccated, heating through electric currents will eventually become inefficient or not viable. Thus, at this point when the water is nearly or completely desiccated, it is necessary to either move onto the next step, or replace water within the formation, for example, through steam injection.

At the step 23, the same or alternate frequency signal is applied to the applicator, which is sufficient to heat the hydrocarbon formation through electric fields, magnetic fields, or both. If the frequency applied in the step 22 is sufficient to heat the hydrocarbon formation through electric fields, magnetic fields, or both then the same frequency signal may be used at the step 23. However, once the water near the applicator is nearly or completely desiccated, applying a different frequency signal can provide more efficient penetration of heat the formation. The frequencies necessary to produce heating through electric fields may vary depending on a number of factors, such as the dielectric permittivity of the hydrocarbon formation, however, frequencies between 30 MHz and 24 GHz are contemplated to heat a typical hydrocarbon formation through electric fields.

The frequencies necessary to produce heating through magnetic fields can vary depending on a number of factors, such as the conductivity of the hydrocarbon formation, however, frequencies between 500 Hz and 1 MHz are contemplated to heat a typical hydrocarbon formation through magnetic fields. Relatively lower frequencies (lower than about 1 kHz) may provide greater heat penetration while the relatively higher frequencies (higher than about 1 kHz) may allow higher power application as the load resistance will increase. The optimal frequency may relate to the electrical conductivity of the formation, thus the frequency ranges provided are listed as examples and may be different for different formations. The formation penetration is related to the radio frequency skin depth at radio frequencies. For example, signals greater than about 500 Hz are contemplated to heat a hydrocarbon formation through electric fields, magnetic fields, or both. Thus, by changing the frequency, the formation can be further heated without conductive electrical contact with the hydrocarbon formation.

At some frequencies, the hydrocarbon formation can be simultaneously heated by a combination of types of radio frequency energy. For example, the hydrocarbon formation can be simultaneously heated using a combination of electric currents and electric fields, electric fields and magnetic fields, electric currents and magnetic fields, or electric currents, electric fields, and magnetic fields.

A change in frequency can also provide additional benefits as the heating pattern can be varied to more efficiently heat a particular formation. For example, at DC or up to 60 Hz, the more electrically conductive overburden and underburden regions can convey the electric current, increasing the horizontal heat spread. Thus, the signal applied in step 22 can provide enhanced heating along the boundary conditions between the deposit formation and the overburden and underburden, and this can increase convection in the reservoir to provide preheating for the later or concomitant application of steam heating. As the desiccated zone expands, the electromagnetic heating achieves deeper penetration within the reservoir. The frequency is adjusted to optimize RF penetration depth and the power is selected to establish the desired size of the desiccated zone and thus establish the region of heating within the reservoir.

At the step 24, steam can be injected into the formation. For example, steam can be injected into the formation through the steam injection pipe 11. Alternatively, steam can also be injected prior to step 22 or in conjunction with any other step.

At the step 25, steps 22, 23, and optionally step 24 are repeated, and these steps can be repeated any number of times. In other words, alternating between step 22, applying a signal to heat the formation through electric currents, and step 23, applying a signal to heat the formation through electric fields or magnetic fields, occurs. It can be advantageous to alternate between electric current heating and electrical field or magnetic field heating to heat a particular hydrocarbon formation uniformly, which can result in more efficient extraction of the heavy oil or bitumen.

Figure 3:
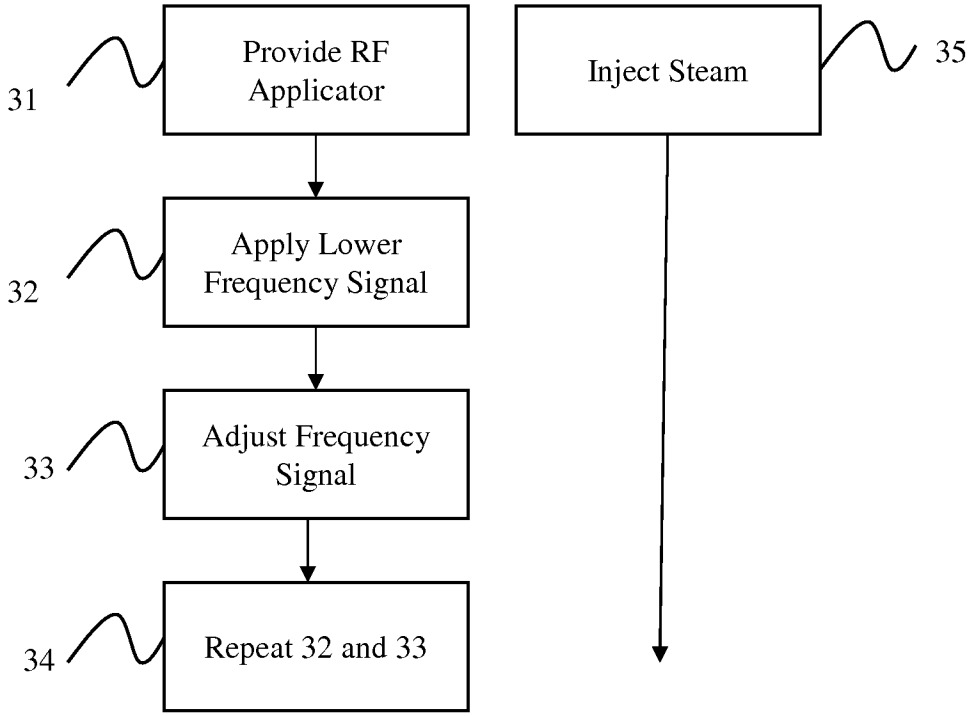
FIG. 3 is a flow diagram illustrating an alternative method of applying heat to a hydrocarbon formation.

Moreover, steam injection can help to heat a hydrocarbon formation more efficiently. FIG. 2 shows steam injected at the step 24 or sequentially with the other heating steps described above. Also, as noted above, steam can also be injected prior to step 22 or in conjunction with any other step. Alternatively, FIG. 3 depicts a method for heating a hydrocarbon formation where steam is simultaneously injected into the formation in conjunction with the RF heating steps 32, 33, and 34.

Figure 4:
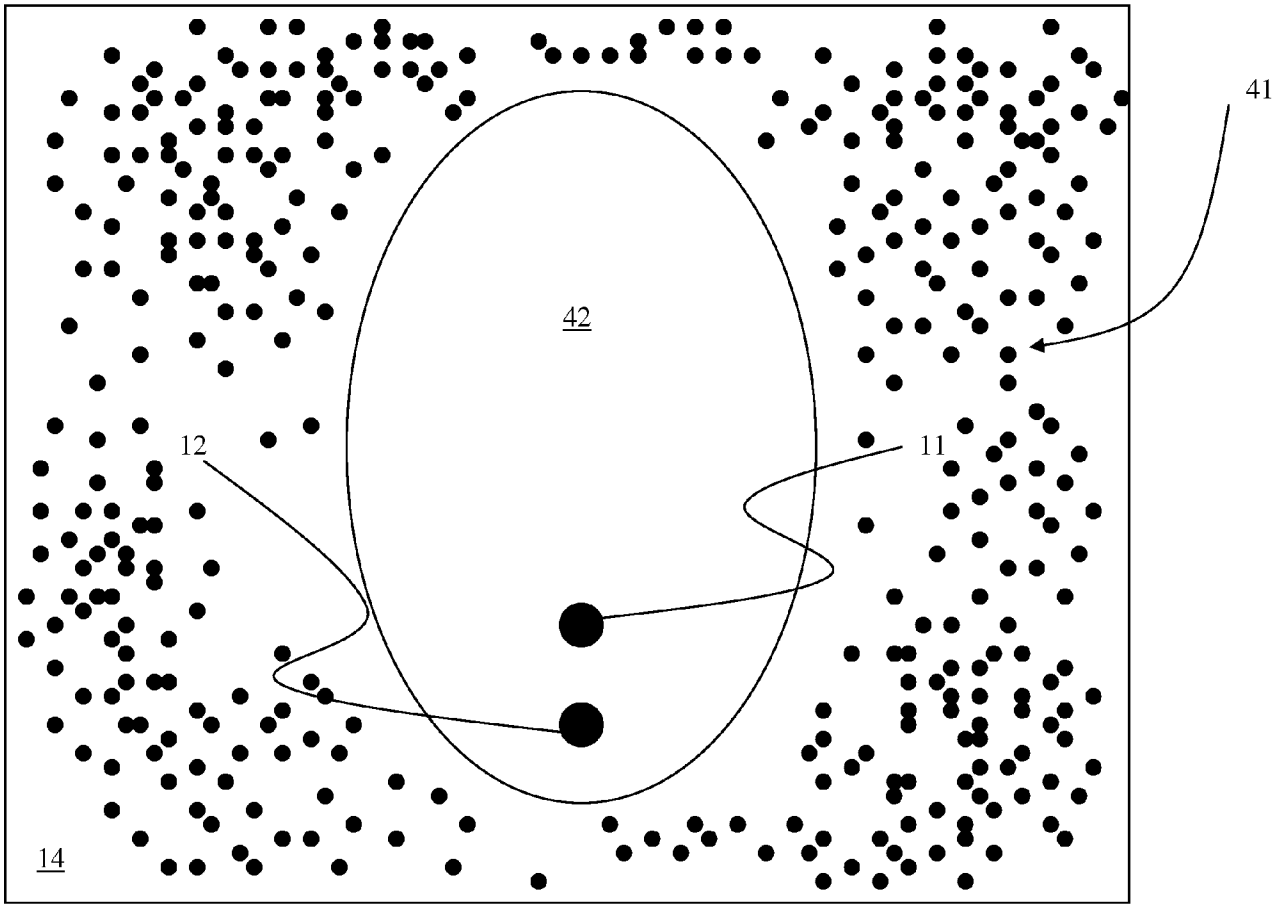
FIG. 4 depicts a steam chamber in conjunction with the present invention.

FIG. 4 depicts heating the hydrocarbon formation through electric fields or magnetic fields as indicated in the step 23 of FIG. 2. Electric fields and magnetic fields heat the hydrocarbon formation through dielectric heating by exciting liquid water molecules 41 within the hydrocarbon formation 14. Because steam molecules are unaffected by electric and magnetic fields, energy is not expended within the steam chamber region 42 surrounding the pipes in the SAGD system. Rather, the electric fields heat the hydrocarbon region beyond the steam chamber region 42.

The heating pattern that results can vary depending on a particular hydrocarbon formation and the frequency value chosen in the step 23 above. However, generally, far field radiation of radio waves (as is typical in wireless communications involving antennas) does not significantly occur for applicators immersed in hydrocarbon formations. Rather the fields are generally of the near field type so the flux lines begin and terminate on the applicator structure. In free space, near field energy rolls off at a $1/r^3$ rate (where r is the distance from the applicator). In a hydrocarbon formation, however, the antenna near field behaves differently from free space. Analysis and testing has shown that dissipation causes the roll off to be much higher, about $1/r^5$ to $1/r^5$. This advantageously limits the depth of heating penetration in the present invention to be substantially located within the hydrocarbon formation. The depth of heating penetration may be calculated and adjusted for by frequency, in accordance with the well-known RF skin effect.

Figure 5:
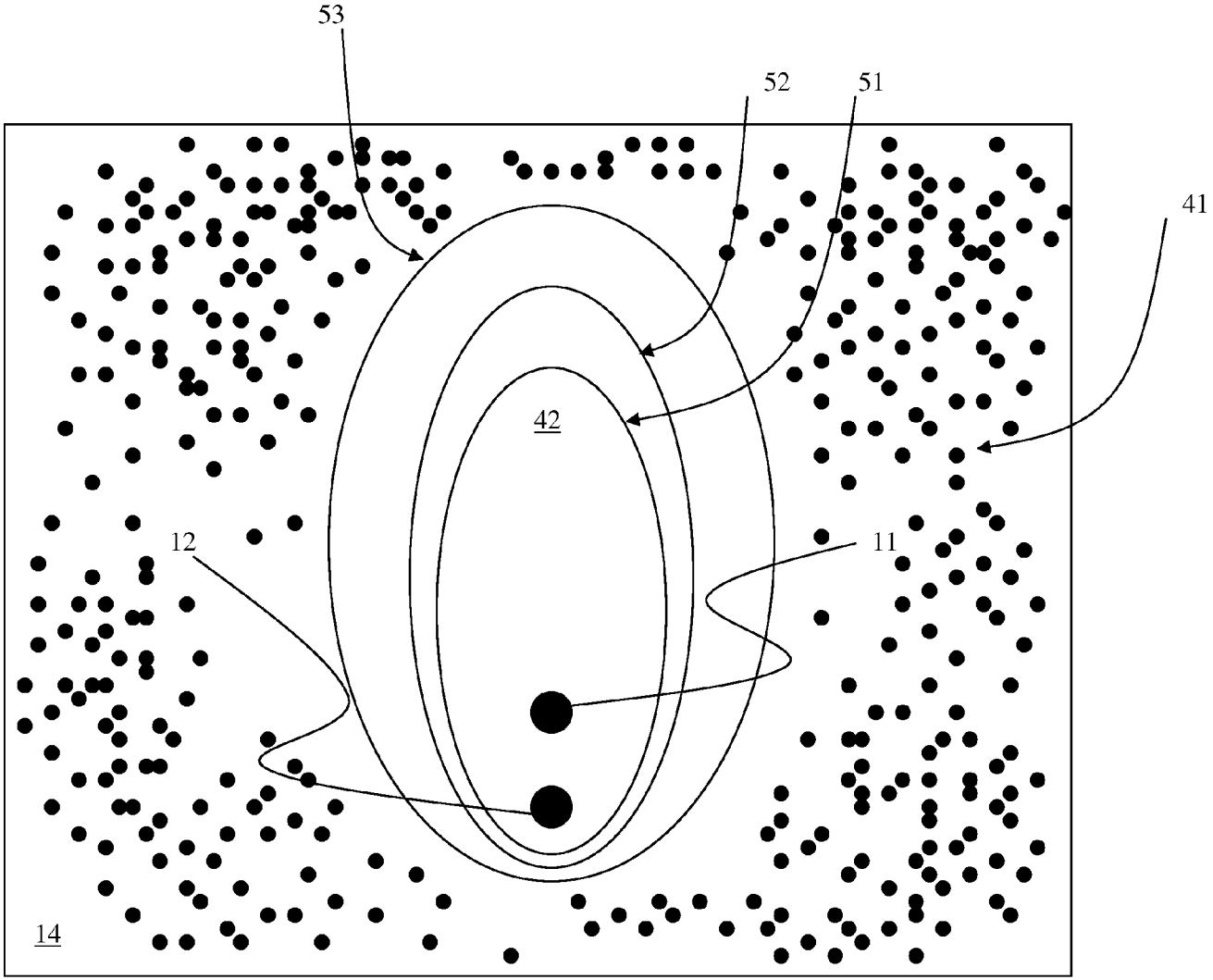
FIG. 5 depicts an expanding steam chamber in conjunction with the present invention.

FIG. 5 shows how the steam chamber 42 expands over time, which allows electric fields and magnetic fields to penetrate further into the hydrocarbon formation. For instance, at an early time $t_0$ the boundary of the steam chamber 42 may be at 51. At a later time $t_1$ after some liquid water has been desiccated and steam is injected into the hydrocarbon formation, the steam chamber 42 may expand to 52. At an even later time $t_2$ the steam chamber 42 can expand to 53. The effect is the formation of an advancing steam front with electromagnetic heating ahead of the steam front but little heating within the desiccated zone.

The radio frequency heating step 23 may also provide the means to extend the heating zone over time as a steam saturation zone may form around and move along the antenna. As steam is not a radio frequency heating susceptor the electric and magnetic fields can propagate through it to reach the liquid water beyond creating a radially moving traveling wave steam front in the formation. Additionally, the electrical current can penetrate along the antenna in the steam saturation zone to cause a traveling wave steam front longitudinally along the antenna.

Figure 6:
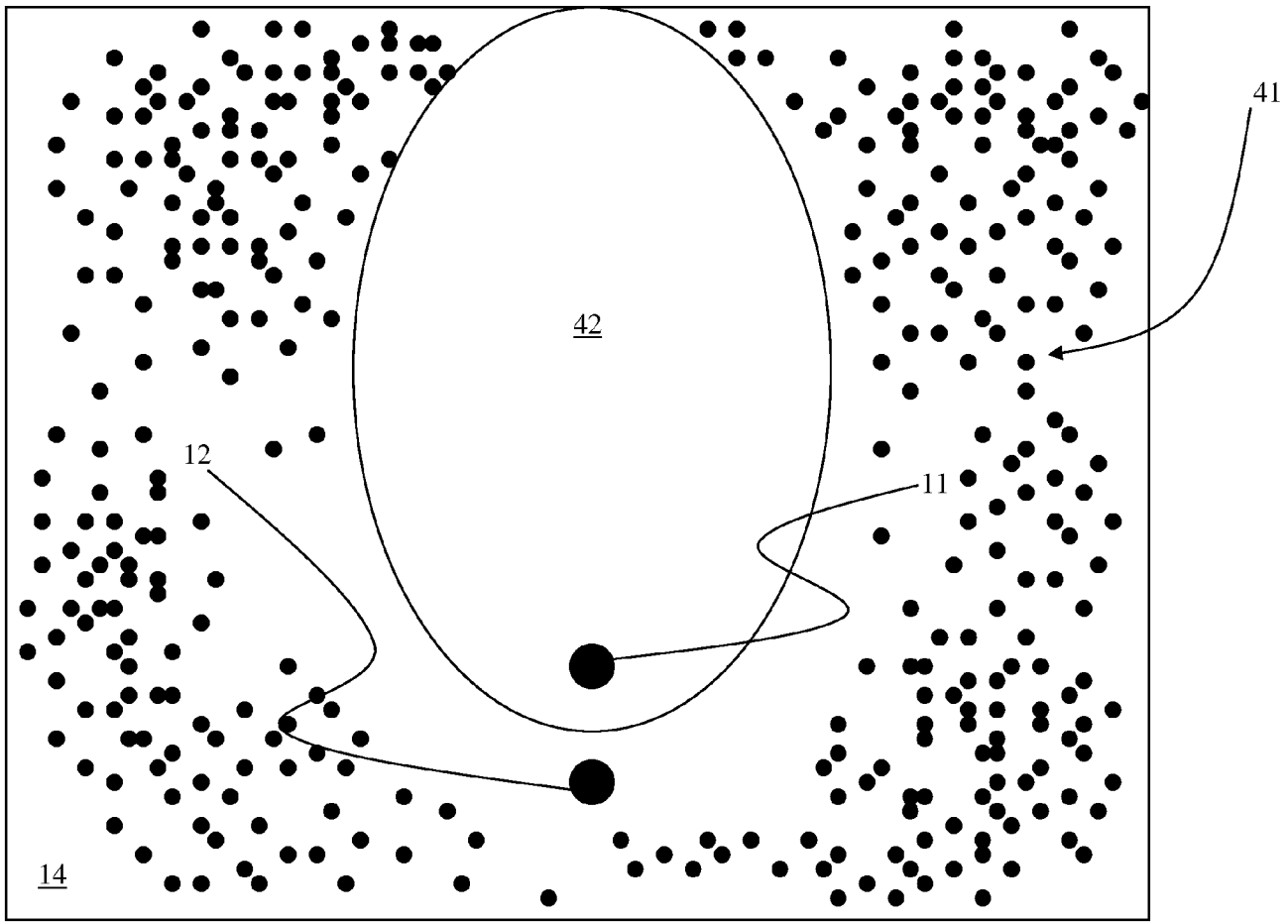
FIG. 6 depicts an alternate location of a steam chamber in conjunction with the present invention.
Figure 7:
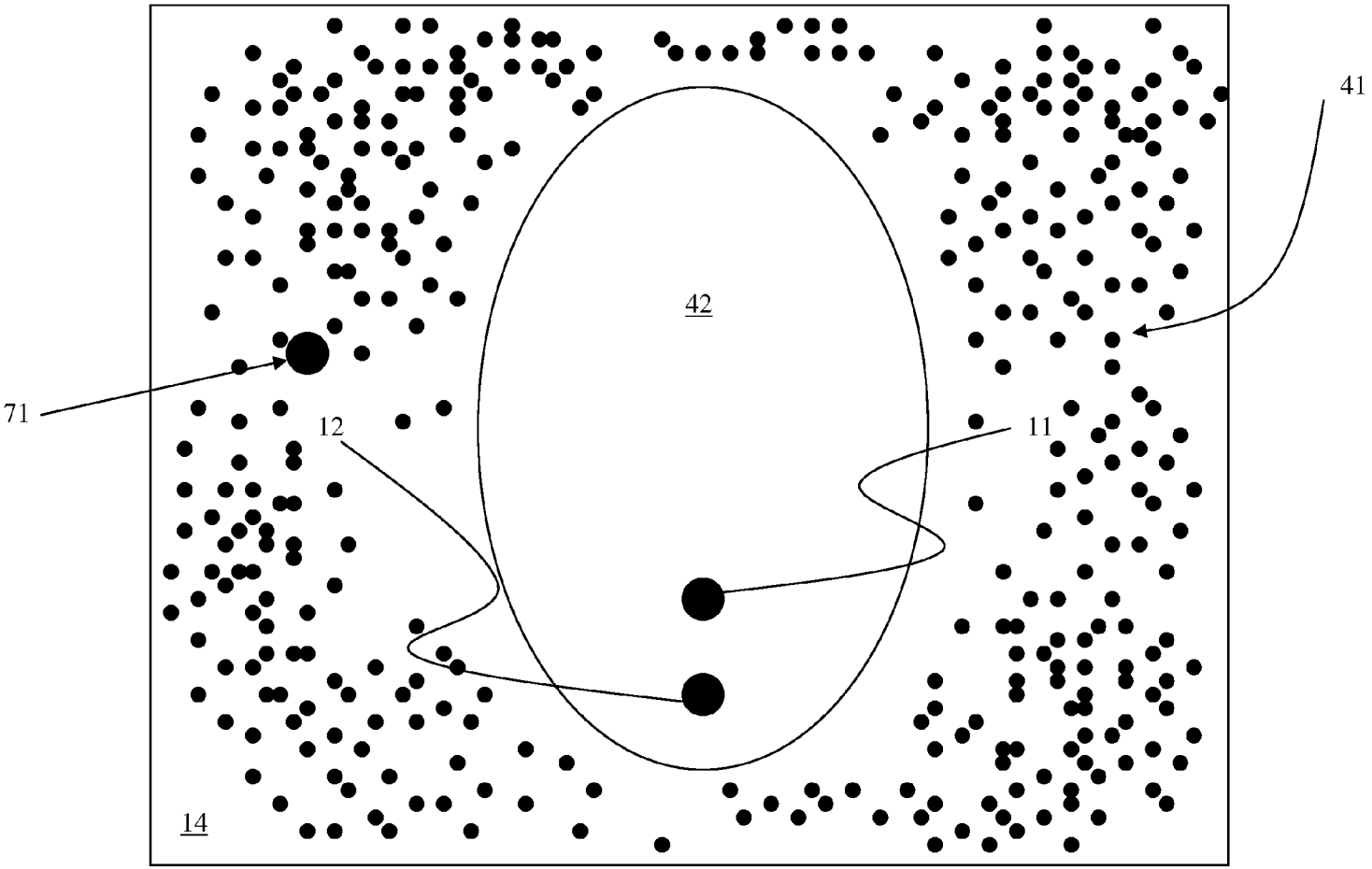
FIG. 7 depicts an alternate location of an antenna in relation to an SAGD system in conjunction with the present invention.

The steam chamber 42 need not surround both the steam injection pipe 11 and the extraction pipe 12. FIG. 6 shows an alternative arrangement where the steam chamber 42 does not surround the extraction pipe 12. Moreover, the applicator need not be located within steam chamber 42 and does not need to be formed from the pipes of an SAGD system as depicted with respect to FIG. 1. FIG. 7 shows an arrangement where an applicator 71 is located within a hydrocarbon formation 14 adjacent to the well pipes 11 and 12 of an SAGD system.

Figure 8:
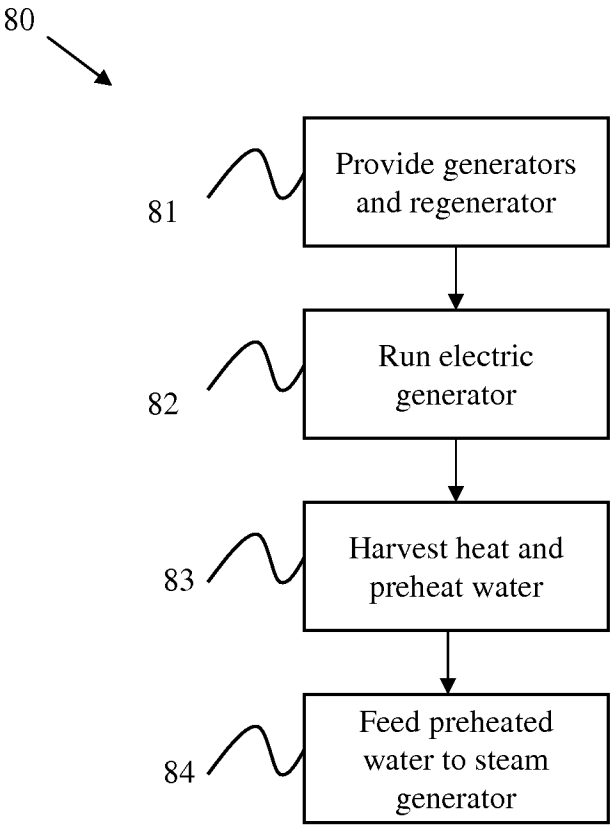
FIG. 8 is a flow diagram illustrating a method of conserving energy in relation to heating a hydrocarbon formation.

FIG. 8 depicts yet another embodiment of the present invention. A flow diagram is illustrated showing a method for efficiently creating electricity and steam for heating a hydrocarbon formation, indicated generally as 80. At the step 81, an electric generator, a steam generator, and a regenerator containing water are provided. The electric generator can be any commercially available generator to create electricity, such as a gas turbine. Likewise, the steam generator can be any commercially available generator to create steam. The regenerator contains water and can include a mechanism to fill or refill it with water.

At the step 82, the electric generator is run. As the electric generator runs, it produces heat as a byproduct of being run that is generally lost energy. At step 83, the superfluous heat generated from running the electric generator is collected and used to preheat the water within the regenerator. At step 84, the preheated water is fed from the regenerator to the steam generator. Because the water has been preheated, the steam generator requires less energy to produce steam than if the water was not preheated. Thus, the heat expended from the electric generator in step 82 has been reused to preheat the water for efficient steam generation. Referring back to FIG. 1, a result of this method is that less total energy is used to create the electricity necessary to power the radio frequency applicator 10 and to create the steam necessary to inject into the hydrocarbon formation 14 through steam injection pipe 11 than if the heat expended from the electric generator was not harvested. Thus, less total energy is used to heat the hydrocarbon formation 14.

Energy in the form of expended heat can also be harvested from other elements in a system, such as that described above in relation to FIG. 1. For example, the transmitter used to apply a signal to the radio frequency applicator can expend heat, and that heat can also be harvested and used to preheat the water in the regenerator. The coupler and transmission line can also expend heat, and this heat can also be harvested and used to preheat the water in the regenerator.

Although preferred embodiments have been described using specific terms, devices, and methods, such description is for illustrative purposes only. The words used are words of description rather than of limitation. It is to be understood that changes and variations can be made by those of ordinary skill in the art without departing from the spirit or the scope of the present invention, which is set forth in the following claims. In addition, it should be understood that aspects of the various embodiments can be interchanged either in whole or in part. Therefore, the spirit and scope of the appended claims should not be limited to the description of the preferred versions contained herein.

The invention claimed is:

1. A method for applying heat to a hydrocarbon formation comprising:

providing a radio frequency applicator positioned to radiate within the hydrocarbon formation;

applying a first radio frequency signal to the radio frequency applicator to supply electric currents via direct conductive electrical contact with the hydrocarbon formation and thereby desiccating water near the radio frequency applicator; and thereafter, applying a second radio frequency signal having a relatively higher frequency than the first radio frequency signal, to the radio frequency applicator to supply at least one of electric and magnetic fields without direct conductive electrical contact with the hydrocarbon formation.

2. The method of claim 1, wherein the second radio frequency signal is sufficient to heat the hydrocarbon formation through electric fields.

3. The method of claim 1, wherein the second radio frequency signal is sufficient to heat the hydrocarbon formation through magnetic fields.

4. The method of claim 1, wherein the second radio frequency signal is sufficient to heat the hydrocarbon formation through both electric fields and magnetic fields.

5. The method of claim 1, comprising:

providing at least one pipe from which to form the radio frequency applicator.

6. The method of claim 5, comprising:

providing at least one pipe in a steam assisted gravity drainage (SAGD) system from which to form the radio frequency applicator.

7. The method of claim 1, comprising:

providing the radio frequency applicator adjacent to an SAGD system.

8. A method for applying heat to a hydrocarbon formation comprising:

providing a radio frequency applicator positioned to radiate within the hydrocarbon formation;

applying a first radio frequency signal to the radio frequency applicator to supply electric currents via direct conductive electrical contact with the hydrocarbon formation and thereby desiccating water near the radio frequency applicator; and applying a second radio frequency signal having a relatively higher frequency than the first radio frequency signal, to the radio frequency applicator to supply magnetic fields without direct conductive electrical contact with the hydrocarbon formation.

9. The method of claim 8, further comprising: injecting steam or dry gas into the hydrocarbon formation.

10. The method of claim 9, wherein the steam or dry gas is injected in sequence with applying the first radio frequency signal and applying the second radio frequency signal.

11. The method of claim 9, wherein the steam or dry gas is injected simultaneously with applying the first radio frequency signal and applying the second radio frequency signal.

12. An apparatus for applying heat to a hydrocarbon formation comprising:

a radio frequency applicator configured to be positioned to radiate within the hydrocarbon formation; and a radio frequency transmitter configured to apply a first radio frequency signal to the radio frequency applicator to supply electric currents via direct conductive electrical contact with the hydrocarbon formation and thereby desiccating water near the radio frequency applicator, and thereafter, apply a second radio frequency signal having a relatively higher frequency than the first radio frequency signal, to the radio frequency applicator to supply at least one of electric and magnetic fields without direct conductive electrical contact with the hydrocarbon formation.

13. The apparatus of claim 12, wherein the radio frequency transmitter is configured to apply the second radio frequency signal sufficient to heat the hydrocarbon formation through electric fields.

14. The apparatus of claim 12, wherein the radio frequency transmitter is configured to apply the second radio frequency signal sufficient to heat the hydrocarbon formation through magnetic fields.

15. The apparatus of claim 12, wherein the radio frequency transmitter is configured to apply the second radio frequency signal sufficient to heat the hydrocarbon formation through both electric fields and magnetic fields.

16. The apparatus of claim 12, wherein the radio frequency applicator comprises at least one pipe.

17. The apparatus of claim 12, wherein the at least one pipe defines an element of a steam assisted gravity drainage (SAGD) system.

* * * * *